US008714552B1

(12) United States Patent
Campo et al.

(10) Patent No.: US 8,714,552 B1
(45) Date of Patent: May 6, 2014

(54) TICKET DISPENSER

(71) Applicants: James A. Campo, Brunswick, OH (US); Timothy J. Manns, Seven Hills, OH (US); Michael J. Gallo, Twinsburg, OH (US); Keith G. Szczepanski, Elyria, OH (US); Glenn C. Johnson, Lodi, OH (US)

(72) Inventors: James A. Campo, Brunswick, OH (US); Timothy J. Manns, Seven Hills, OH (US); Michael J. Gallo, Twinsburg, OH (US); Keith G. Szczepanski, Elyria, OH (US); Glenn C. Johnson, Lodi, OH (US)

(73) Assignee: E-Max Gaming Corporation, Cleveland, OH (US)

( * ) Notice: Subject to any disclaimer, the term of this patent is extended or adjusted under 35 U.S.C. 154(b) by 0 days.

(21) Appl. No.: 13/664,779

(22) Filed: Oct. 31, 2012

(51) Int. Cl.
*A63B 71/00* (2006.01)

(52) U.S. Cl.
USPC ..... 273/148 R

(58) Field of Classification Search
USPC ..... 273/148 R
See application file for complete search history.

(56) References Cited

U.S. PATENT DOCUMENTS

| | | | | |
|---|---|---|---|---|
| 3,190,004 | A * | 6/1965 | Land et al. | 33/732 |
| 5,160,076 | A * | 11/1992 | Ford | 225/4 |
| 5,944,219 | A * | 8/1999 | Emoff et al. | 221/45 |
| 6,267,267 | B1 * | 7/2001 | Johnson et al. | 222/56 |
| 6,293,424 | B1 | 9/2001 | Love | |
| 6,726,077 | B2 * | 4/2004 | Roberts et al. | 225/103 |
| 6,932,258 | B1 * | 8/2005 | Roberts et al. | 225/103 |
| 7,454,385 | B2 | 11/2008 | Prasad et al. | |
| 7,950,996 | B2 | 5/2011 | Nguyen et al. | |
| 8,540,182 | B2 * | 9/2013 | Martineck, Sr. | 242/594.4 |

* cited by examiner

*Primary Examiner* — Kurt Fernstrom
*Assistant Examiner* — Dolores Collins
(74) *Attorney, Agent, or Firm* — Fay Sharpe LLP

(57) ABSTRACT

A ticket dispenser includes a first engaging member advancing a ticket at a first rate of speed, a second engaging member advancing the ticket at a second, greater, rate of speed and a third engaging member advancing the ticket at a third, even greater, rate of speed. The ticket has length greater than a) the spacing between the first and second engaging members and b) the spacing between the second and third engaging members. As the ticket advances through the ticket dispensing mechanism, the second engaging member engages the ticket before the first engaging member disengages the ticket and the third engaging member engages the ticket before the second engaging member disengages the ticket. A force of the second ticket engaging member is greater than that of the first and third engaging members.

12 Claims, 7 Drawing Sheets

TICKET DISPENSER

BACKGROUND

The present exemplary embodiment relates to gaming systems and methods. It finds particular application in conjunction with game card machines, and will be described with particular reference thereto. However, it is to be appreciated that the present exemplary embodiment is also amenable to other like applications.

Pull tab tickets or game cards are often used for gaming and entertainment. In the past, a common practice has been for a merchant to buy an inventory of tickets and retain them in a jar or other container. Customers purchase the tickets and open them to reveal the outcome for the ticket.

The individual pull tab tickets are typically fashioned from paper and are rectangular. A portion of the ticket, the window, is printed with the outcome (an indicium such as a symbol or an alphanumeric character). To conceal the window of the ticket, a flap is positioned over it. When the ticket is purchased, the flap is pulled back by a player to reveal the outcome. The ticket may be printed with serial numbers or other material to identify the ticket and the game.

As mentioned, the outcome may be a combination of symbols, e.g. 7's, cherries, bells, gold nuggets, or "bar" symbols, often of the type found in slot machines. The outcome may also be a number or series of numbers. For the game to which the tickets pertain there is a pay schedule for the outcomes, i.e. three gold nuggets win twenty dollars. In other instances, winning numbers are posted for the customer to compare. If the outcome of the ticket matches a winning outcome, the establishment pays the player the indicated amount. If the outcome is a losing outcome, the ticket is a loser and the purchaser receives no prize. The schedule of prizes or awards is designed, for the number of tickets printed and sold for the game, to provide the establishment with a profit.

More recently, ticket dispensing machines have been developed for allowing customers to purchase pull tab tickets via an automated process. Such machines typically are capable of accepting one or more forms of payment (cash, coins, etc.) and dispensing one or more tickets. Some machines have multiple columns containing pull tab tickets for a number of different games. By automating the ticket dispensing process, the machines free up employee time that would otherwise be spent selling the tickets to customers. In addition, the machines can offer greater security of the tickets as opposed to storing unsold tickets in a jar or the like.

While ticket dispensing machines have generally improved the overall ticket sale process, redeeming winning tickets for payment and/or checking/verifying a ticket once it has been sold is still generally performed manually. There is also room for improvement in the dispensing mechanisms.

BRIEF DESCRIPTION

In accordance with one aspect, a ticket dispensing mechanism for dispensing a single associated ticket from a stack of associated tickets comprises a first ticket engaging member for advancing the single associated ticket at a first rate of speed, a second ticket engaging member located downstream of the first ticket engaging member for advancing the single associated ticket at a second rate of speed which is greater than the first rate of speed, a third ticket engaging member located downstream of the second ticket engaging member for advancing the single associated ticket at a third rate of speed which is greater than the second rate of speed. The associated ticket has length greater than a) the spacing between the first and second ticket engaging members and b) greater than the spacing between the second and third ticket engaging members such that as the associated ticket advances through the ticket dispensing mechanism, the second ticket engaging member engages the associated ticket before the first ticket engaging member disengages the associated ticket and the third ticket engaging member engages the associated ticket before the second ticket engaging member disengages the associated ticket, and the second ticket engaging member engages an associated ticket with a force greater than a force of engagement of the first and third ticket engaging members, whereby the speed of the associated ticket is determined by the second ticket engaging member when the associated ticket is engaged with the second ticket engaging member.

The first, second and third ticket engaging members each can include at least one roller adapted to engage a surface of an associated ticket. Each of the at least one roller of the first, second and third ticket engaging members can be operatively coupled to a common drive gear. The second ticket engaging member can include a toothed roller for engaging a surface of an associated ticket. The associated ticket can have a length greater than the combined distance of the spacing between the first and second ticket engaging members and the spacing between the second and third ticket engaging members such that as the associated ticket advances through the ticket dispensing mechanism, the first, second and third ticket engaging members can simultaneously engage the associated ticket. The mechanism can further comprise a stripper arm positioned between the second and third ticket engaging members for removing a flap of an associated ticket, and/or a ticket scanner for scanning information from the associated ticket.

In accordance with another aspect, a game card dispensing system comprises a game card dispenser for dispensing associated game cards, and a game card processing device for processing an associated game card in communication with the game card dispenser, the game card processing device including a scanner for scanning information on the associated game card, a processor configured to determine whether the associated game card is a winner based at least in part on the information scanned by the scanner, and a communication interface for sending a signal to the game card dispenser indicative of a credit value associated with an associated winner game card. The game card dispenser is configured to receive said signal from the game card processing device and, in response thereto, credit a corresponding amount of game card credits for use in purchasing additional associated game cards to be dispensed from the game card dispensing device, and the processing device further includes a defacing device for defacing an associated game card after scanning and after game card credits have been credited.

The defacing device can include a mechanical punch for physically destroying a portion of the associated game card. The system can further comprise a user interface operative to communicate a credit value of the associated winner game card, and to receive input from a user whether to send the signal indicative of the credit value to the associated game card dispenser or return the associated winner game card to the user.

In accordance with still another aspect, a method of processing a game card dispensed from a game card dispenser comprises the steps of i) scanning a game card to extract data from the card, ii) determining if the game card is a winning game card based at least in part on the extracted data, iii) determining a credit value associated with a winning game card, and iv) communicating the credit value to the game card dispenser wherein said credit value can be used for purchasing additional game cards from the game card dispenser.

The method can further comprise, prior to the communicating step, indicating the credit value to a user, and offering the user the option to either communicate the credit value to the game card dispenser for purchasing additional game cards from the game card dispenser or returning the game card to a user without communicating the credit value to the game card dispenser.

The method can also include the step of defacing the game card after scanning. The defacing step can include physically destroying a portion of the game card. The method can also include the step of retaining the game card after the scanning step, and/or the step of recording the extracted data in a database, and/or the step of communicating the data recorded in the database via at least one of printing the data or transmitting the data to another device removed from the game card processing device.

DETAILED DESCRIPTION

Figure 1:
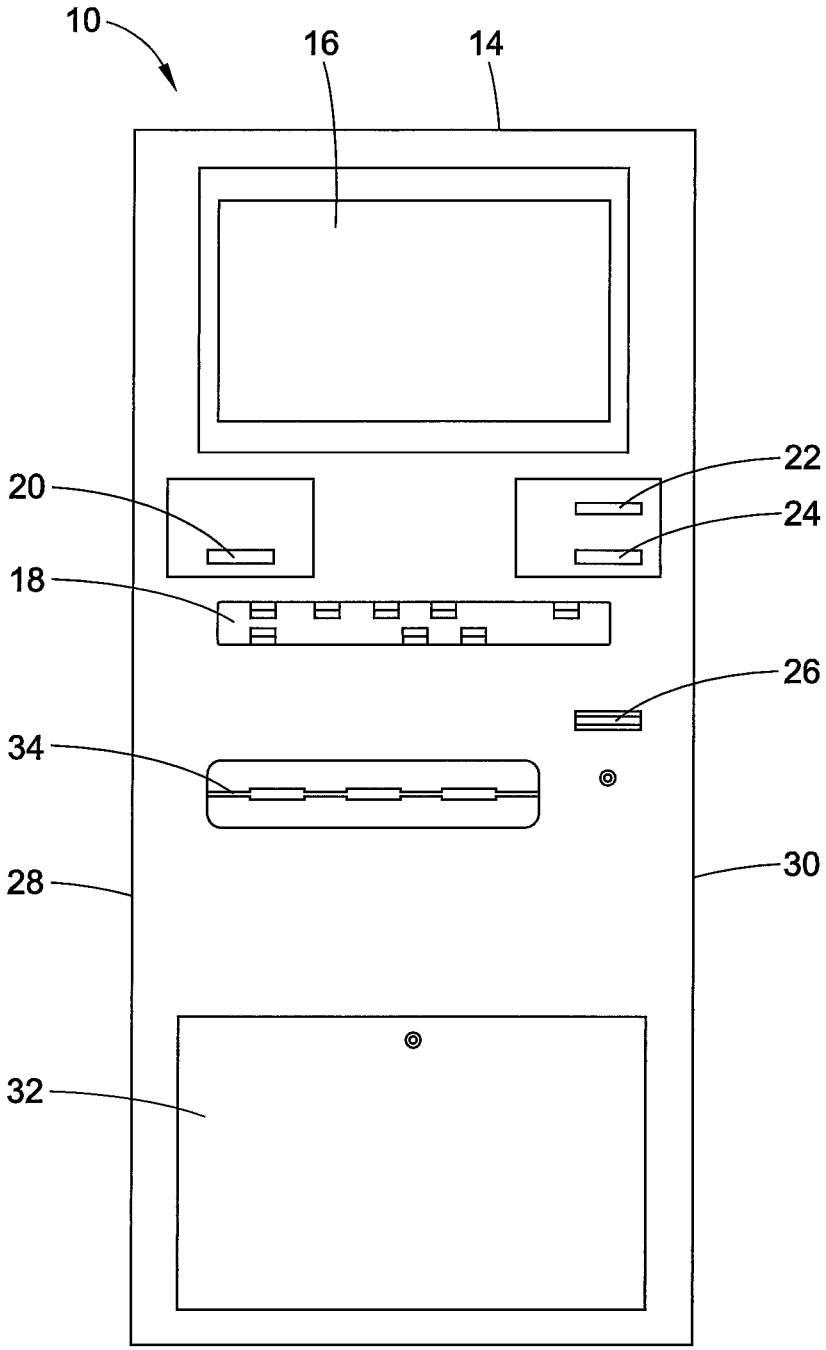
FIG. 1 is a front view of an exemplary game card dispensing system in accordance with a first embodiment of the present disclosure.

With reference to the drawings, and initially FIG. 1, an exemplary ticket dispenser in accordance with a first embodiment of the present disclosure is illustrated and generally indicated by reference numeral 10. The dispenser 10 includes a dispenser housing or cabinet 14 in which the various components for dispensing tickets are contained. The front face of the cabinet 14 includes a display 16 for displaying information related to gaming and/or the dispensing of tickets, transaction details, winner notifications, etc. The display can be any suitable display, such as an LCD display or the like. The front face 14 also includes various user inputs in the form of buttons 18 provided to enable a player to select a desired type of ticket to be dispensed, and for otherwise operating the dispenser 10.

Situated between the display 16 and the buttons 18 are a ticket slot 20, a ticket out voucher slot 22, and a player tracking card slot 24. The ticket slot 20 is configured to accept a dispensed ticket and, in the case of a winning ticket, issue credits for purchasing additional tickets from the dispenser. The voucher slot 22 delivers a printed voucher ticket to a player that can be taken to a cashier or automated machine for cashing out winnings. The player tracking card slot 24 receives a unique player ID card issued to the player by the gaming facility for tracking game play.

The front face of the dispenser 10 also includes a bill acceptor 26 configured to accept cash from a player during a gaming session, a dispensed ticket hopper 28 into which purchased and dispensed tickets drop, as well as a cash box access door 30 and a dispensed ticket lock box 32. Collection hopper 28 on the dispenser 10 can collect tickets as they are dispensed. A local microprocessor controlled motor can rotate a door at the bottom of the collection hopper such that the tickets slide out of the hopper into a box located in a base cabinet mounted under the main dispenser cabinet. The dumping of tickets can be triggered manually by a player or by a multitude of different programmable conditions determined by the dispenser product. Conventional products generally do not have a ticket collector and housekeeping function to keep the gaming premises clean of dispensed tickets without the intervention of player or housekeeping personnel. The illustrated ticket dispenser 10 incorporates four bar coded ticket dispensing columns 34 from which tickets are issued, but more or fewer columns could be provided as desired. The tickets in the several columns can cost different amounts (such as 50¢, $1.00, 25¢, etc.), pertain to different games, or both.

Figure 2:
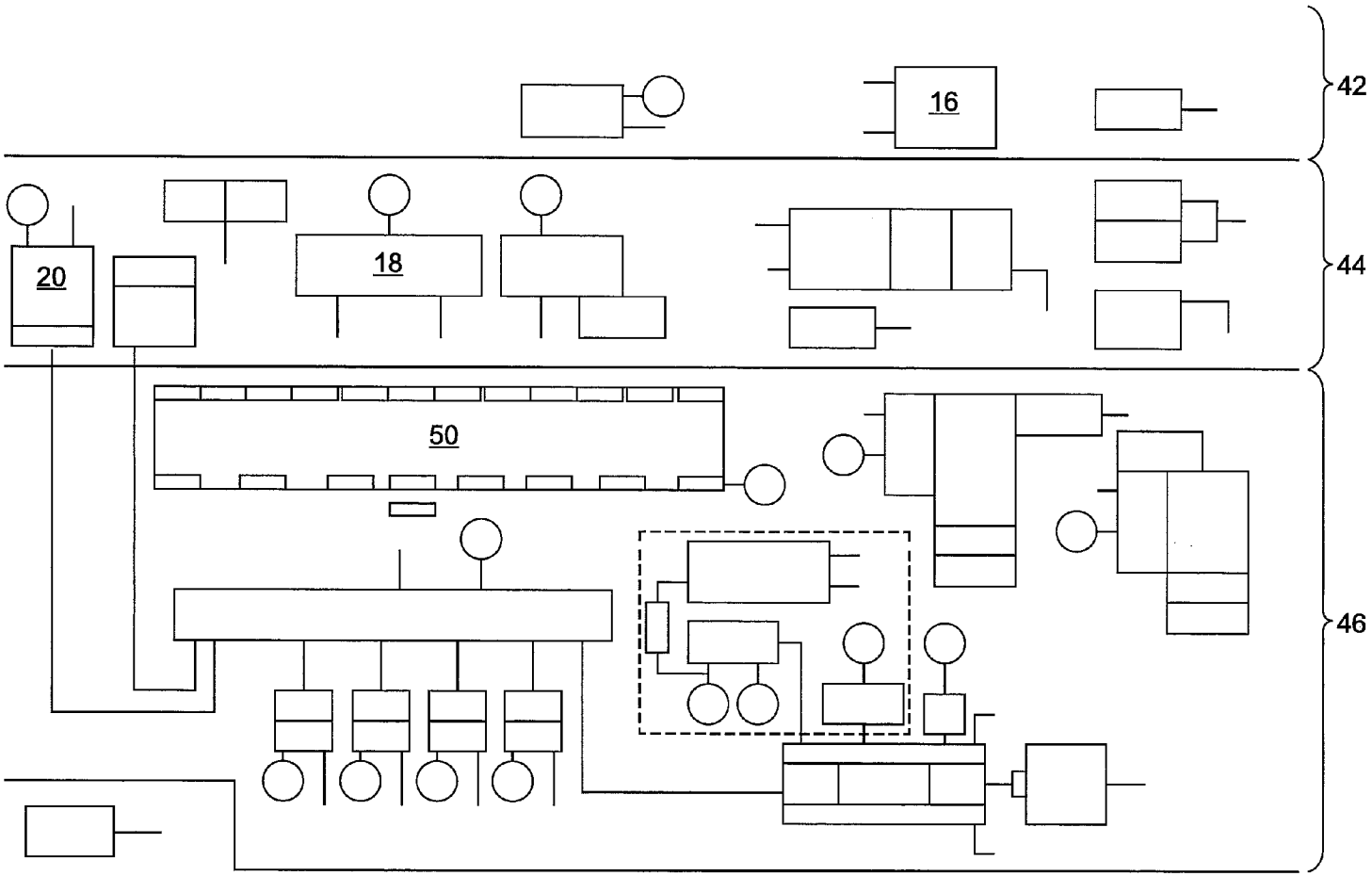
FIG. 2 is a block diagram of illustrating various components of the game card dispensing system of FIG. 1.

Turning to FIG. 2, the various exemplary components of the ticket dispenser 10 are shown. The components are generally divided into three groups: a display group 42 including, for example, display 16; a main cabinet door group 44 including, for example, buttons 18, ticket slot 20 etc.; and a main cabinet group 46 including, inter alia, a CPU module 50 for controlling the various components of the ticket dispenser 10. It will be appreciated that FIG. 2 illustrates but one example of a ticket dispenser in accordance with the disclosure, and that some of the components illustrated can be omitted and other components added to the device as desired.

Turning to FIGS. 3-6, it should be appreciated that each dispensing column 34 of the ticket dispenser 10 is configured to feed a single ticket from a stacked pile of tickets in a vertical column contained within the cabinet 14, advance the ticket to a main, predominant, drive roller, strip a window flap on the ticket to expose an underlying bar code, advance the ticket and accurately stop the ticket at a position in which a bar code scanner can read the bar code, restart the motor drive and advance the ticket to fully expel the ticket from the dispensing column 34, or partially expel and hold the ticket in the partial expel position, all while a second ticket is simultaneously being fed through the dispensing column. With a full or partial expel of the first ticket, the second ticket will stop ahead of the stripping mechanism such that the bar code is not exposed on the second ticket to be dispensed next.

Figure 3:
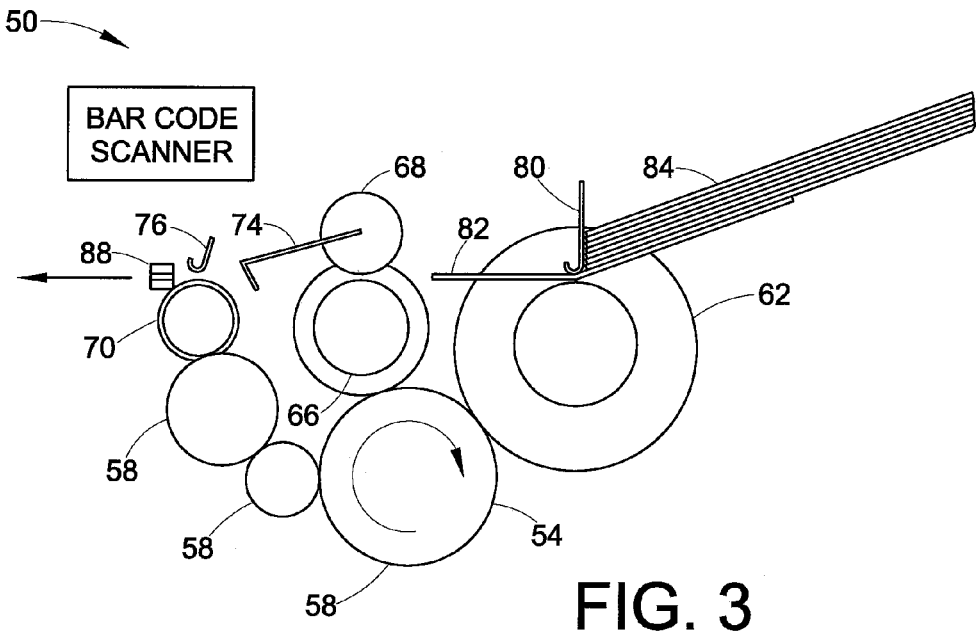
FIG. 3 is a schematic illustration of an exemplary ticket dispenser in accordance with the present disclosure showing a ticket in a first position.

To accomplish the mechanical dispensing and timing of tickets through a column, as shown in FIG. 3 a dispenser mechanism 50 in accordance with the present disclosure includes a DC motor driven gear 54, various timing gears 58, an input roller 62 which can be made of an elastomeric material, a metal toothed drive roller 66 and mating elastomeric pinch roller 68, an elastomeric output roller 70, a stripper arm 74, a spring tension foot 76, a ticket sensor 88 and a ticket gate 80. A microprocessor motor controller, such as CPU module 50 (FIG. 2), is configured to control the components as described below.

As a ticket passes through the dispensing mechanism 50, the ticket experiences three different velocities. The three velocities are achieved via the ticket being driven by at least one of the feed roller 62, the toothed roller 66 and/or the output roller 70. In one embodiment, the tickets have a length of about 3.9 inches, while the distance between the centers of the feed roller 62 and the output roller 70 is about 3.6 inches, in other words, shorter than the ticket length. As the ticket is fed from the ticket gate 80, the velocity of the ticket, is determined by the friction between the ticket and feed roller 62.

Figure 4:
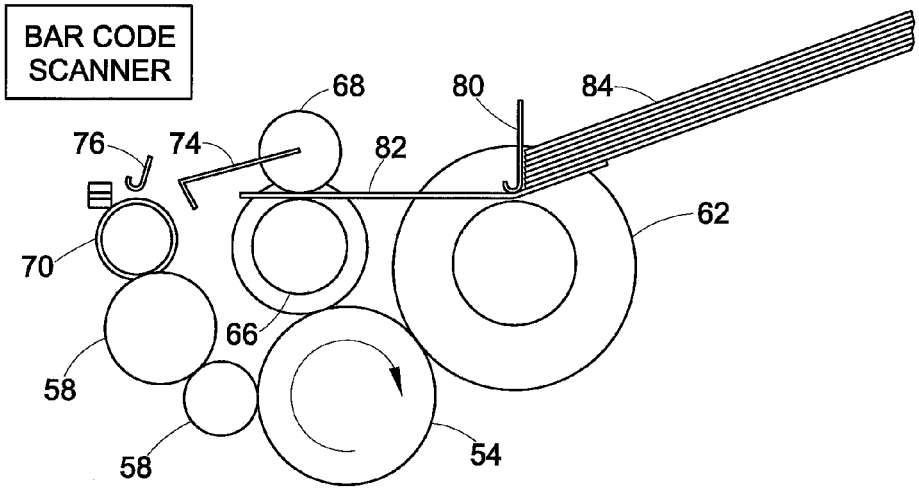
FIG. 4 is a schematic illustration of an exemplary ticket dispenser in accordance with the present disclosure showing a ticket in a second position.

In operation, a single ticket 82 is advanced by feed roller 62 at a first speed V1 from the bottom of a stack or column of tickets 84 (FIG. 3) until it is captured by the elastomeric pinch roller 68 and the metal toothed roller 66 (FIG. 4). The teeth of the toothed roller 66 securely capture the ticket 82 with a force much larger than the friction from feed roller 62. The ticket 82, once engaged by the metal toothed roller 66, is now at a velocity, V2, determined predominately by metal toothed roller 66 even though the ticket 82 is still in contact with the feed roller 62. Given that the metal toothed roller has a greater grip on the ticket 82, slippage of the ticket occurs at feed roller 62 as the ticket 82 is advanced by the toothed roller 66. Slight indentations in the face of the cardboard ticket can be caused by the teeth of the roller 66. In one embodiment, the elastomeric input pinch and output rollers can comprise rubber and the metal of the toothed roller can comprise brass.

Figure 5:
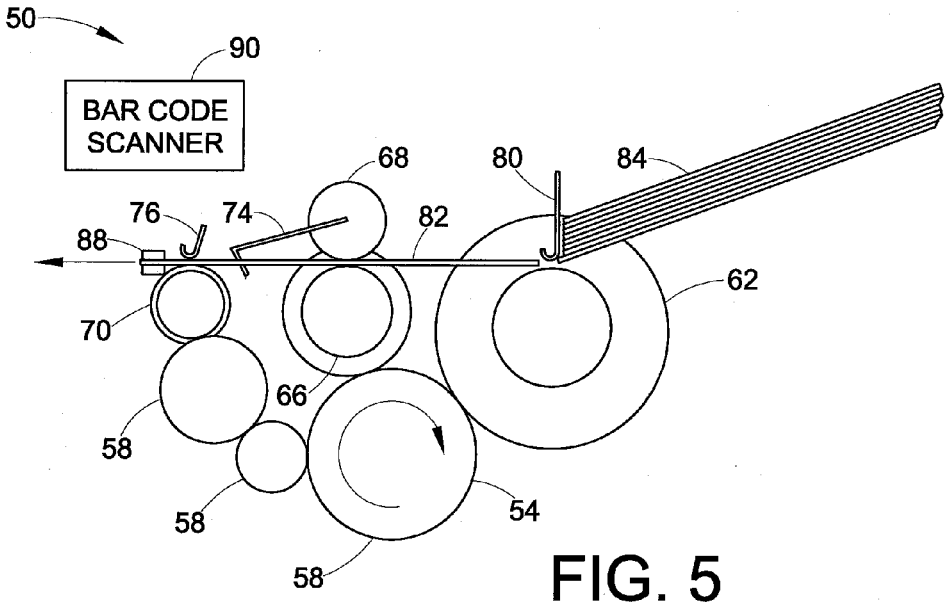
FIG. 5 is a schematic illustration of an exemplary ticket dispenser in accordance with the present disclosure showing a ticket in a third position.

As shown in FIG. 5, as the ticket 82 continues through the mechanism 50 it advances until the end of the ticket 82 is captured by the stripper arm 74. The ticket 82 is driven with a substantial force by toothed roller 66 and the ticket window of the ticket 82 gets stripped back by the arm 74 but not detached from the main ticket body. An underlying bar code on the inside of the ticket 82 is now exposed. The ticket 82 is advanced until a ticket slot detector/sensor 88 output notifies the motor microprocessor (e.g. microprocessor 50, or other controller) that the ticket 82 is in a position to be scanned by a scanner 90, which in this embodiment is a bar code reader. The microprocessor accurately stops the motor utilizing, for example, microprocessor electronic braking. In advancing to this position, the ticket 82 was simultaneously engaged with all four rollers.

With a stopped ticket 82 at the scanner 90, the scanner 90 reads the now exposed bar code of the ticket 82. The information read can be displayed on the screen 16 as is known in the art. The motor is then started again and the ticket 82 is advanced by toothed roller 66 until the ticket disengages with toothed roller 66. Now output roller 70 determines the ticket velocity, V3. Prior to disengagement with the toothed roller 66, the basic velocity of the ticket 82 is still determined by the predominate force and velocity of toothed roller 66. Again there is slippage on feed roller 62 and output roller 70. The spring tension applied by spring foot 76 on output roller 70 is designed for less friction than that imparted by toothed roller 66. However, the spring force on output roller 70 is designed with enough friction to drive the ticket 82 out of the column when toothed roller 66 is no longer in contact with ticket 82.

Figure 6:
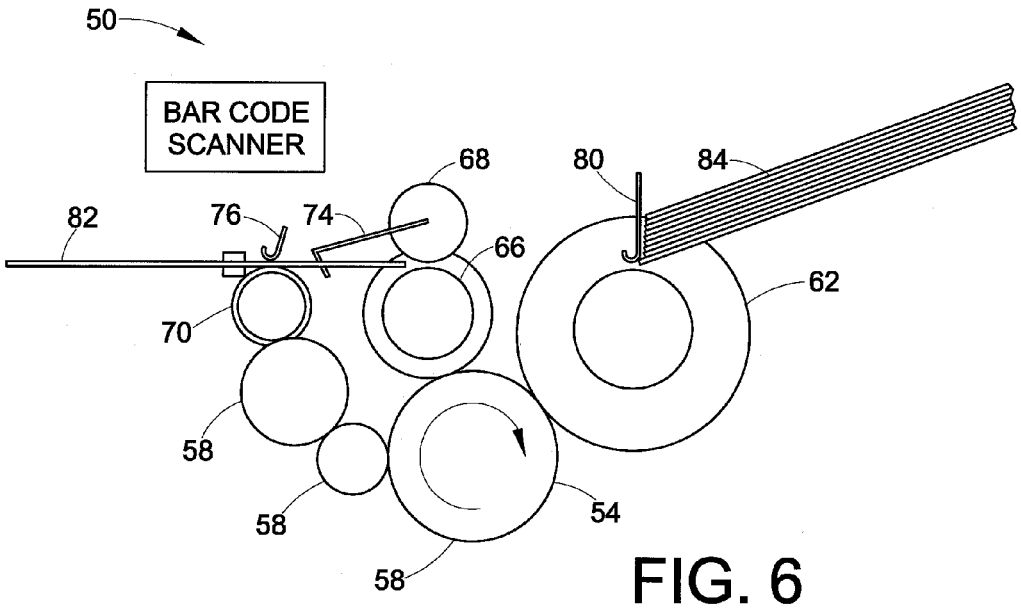
FIG. 6 is a schematic illustration of an exemplary ticket dispenser in accordance with the present disclosure showing a ticket in a fourth position.

Referring to FIG. 6, with the ticket 82 in this partially expelled position, the microcontroller can immediately stop the ticket with electronic braking and the ticket 82 can be held in place by the spring tension via spring foot 76 acting on output roller 70. The partially expelled position can be used to stop on a winning ticket and the ticket 82 can be manually pulled out of the dispenser by the player. Since the ticket 82 is still in the sensor slot, the sensor can be used to monitor when the player has removed the ticket. Note that if a player never removes the partially expelled ticket, and a new, second, ticket is played, the first ticket 82 will automatically expel itself via output roller 70 as drive gear 54 begins to rotate.

Optionally, in the case of a non-winning first ticket, the microprocessor would not stop the ticket in this partial position and continue to let output roller 70 fully drive the ticket out of the dispenser at V3. While the first ticket is being expelled, the second ticket is advancing to engage with toothed roller 66, but does not come in contact with the stripper arm 74 until the first ticket is expelled. This is accomplished by designing output roller 70 to drive the first ticket at a higher velocity than feed roller 62 to allow the first ticket to rapidly expel while the next ticket is being advanced into the dispensing mechanism 50 at a slower rate.

It will be appreciated that timing of the ticket travel through the dispensing mechanism 50 is affected by many factors including ticket length, distance between the shafts, gear ratios, motor RPM, the stripper arm position, and ticket window length, for example. The same mechanism 50 will also support a ticket length that simulataneously engages only two of the ticket engaging members. Accordingly, it is also possible to change the various parameters of the mechanism to achieve a desired dispensing effect for different size tickets.

Occasionally, the bar code on a dispensed ticket may not have been read by the bar code scanner 90. This can be caused by human error such as loading a ticket upside down in the dispensing column. In the case of an improper read, the ticket will partially expel to allow the player to manually open the ticket and determine if it was a winner. If a winner, the player can insert the ticket into a ticket redemption slot (e.g., slot 20 in FIG. 1) and a slot bar code scanner will read the ticket and process the ticket as if it had been properly dispensed.

Figure 7:
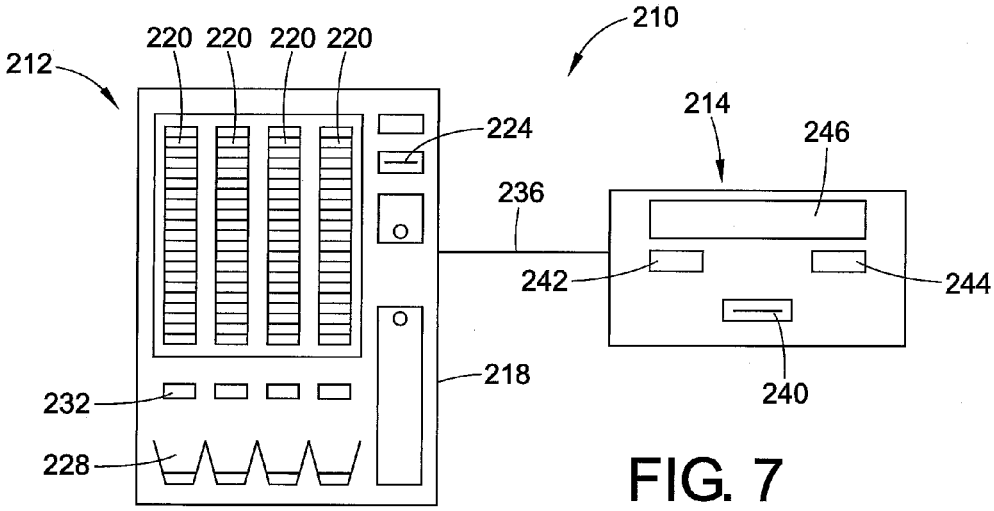
FIG. 7 is a front view of an exemplary game card dispensing system having a game card dispenser and a game card processing device in accordance with a second embodiment of the present disclosure.

With reference to FIG. 7, a game card dispensing system according to a second embodiment of the present disclosure is illustrated and identified generally by reference numeral 210. The game card dispensing system 10 includes a game card dispenser 212 for dispensing game cards, and a game card processing device 214 for processing game cards dispensed from the dispenser 212.

The dispenser 212 can be any suitable game card dispensing unit. The illustrated dispenser 212 includes a housing 218 in which four columns 220 of game cards are stored for dispensing. The columns of game cards 220 are visible through a clear plastic or glass viewing window that allows players to view the various different types of games represented by each stack of game cards 220. The dispenser 212 also includes a device for accepting payment from a player prior to dispensing of one or more game cards. The payment device in the illustrated embodiment is a bill collector 224 adapted to accept and validate currency such as one dollar, five dollar, ten dollar and twenty dollar bills. The device 212 can also be adapted to accept coins and/or debit cards or credit cards, or any other payment types.

In use, the dispenser 212 is configured to accept payment via the bill collector 224 and to dispense one or more game cards from the rows of game cards 220 into a hopper 228 for collection by the player. To this end, a card selection button 232 is associated with each column 220 of game cards and is configured to dispense one or more game cards when depressed by a player, provided that the player has inserted sufficient money into the dispenser 212 for the transaction.

Connected to the game card dispenser 212 via an input/output link 236 is the game card processing device 214. The game card processing device 214 in the exemplary embodiment includes a game card processor 240, an accept button 242, a reject button 244 and a display 246. As will be appreciated, the game card processor 240 is adapted to accept a game card, scan the game card, and determine whether the game card is a winning game card, and if so, the amount of a credit value associated with a game card determined to be a winning game card. If a game card is inserted into the game card processor 240 and determined to be a winning game card, then the credit value associated with the winning game card is displayed on the display 246. A user is then prompted to either redeem the game card in exchange for credits on the dispenser 212 for buying additional game cards, by pressing the accept button 242, or the player can press the reject button 244 and the game card which was inserted into the game card processor 240 is returned to the player.

It will be appreciated that in a more basic embodiment, a player can be instructed that inserting a card into the game card processing device 214 is constructive acceptance of the offer to redeem the card for credits on the dispenser 212 (provided certain other conditions are met, as will be described herein). In such a device, the user interface (buttons 242 and 244, and display 246) could be eliminated altogether and replaced with instructions to the player that the only outcome of inserting a game card into the game card processor 240 is the crediting of any winning card value to the game card dispenser 212.

Accordingly, the game card dispensing system 210 in FIG. 7 is a fully automated dispensing and redeeming system. The system encourages users to continue playing additional game cards by eliminating the need to engage establishment personnel in order to redeem a winning card. In the past, winning cards of small amounts such as one dollar, two dollars, five dollars, etc. would often be redeemed in aggregate at the end of a player's session of play. Because a player would have to leave the dispensing machine and engage personnel in order to redeem the winning cards, the player may be more inclined to end his or her play session at that time. By providing a player a convenient way to redeem winning game cards for credits for the purchase of additional game cards, the user may be more likely to extend a game play session by "reinvesting" the winnings from winning game cards for additional game cards.

Figure 8:
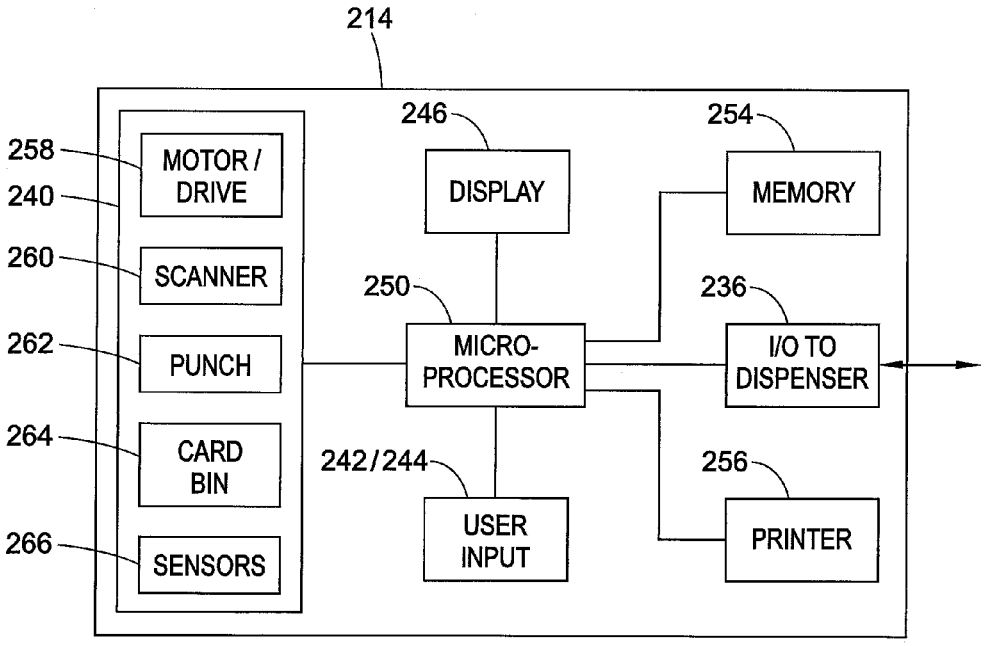
FIG. 8 is a block diagram of the exemplary game card processing device of FIG. 7.

Turning now to FIG. 8, a block diagram of the game card processing device 214 is illustrated. As mentioned, the device 214 includes game card processor 240, user input 242/244 and display 246. As will be appreciated, these components are operatively connected to a microprocessor 250 that, as will be described in more detail below, carries out various processes related to the processing of a game card. The microprocessor 250, and by extension the other components of the processing device 214, are connected to the dispenser 212 via input/output link 236. The processing device 214 also includes a memory 254 for storing data and/or software related to processing of game cards, and a printer 256 or other recording device for maintaining a record of transactions executed by the game card processing device 214.

The game card processor 240 can include a motor drive 258 adapted to advance/return a game card. The motor drive 258 can be configured to sense when a game card is placed at an opening of the game card processor 240 and in response advance the game card to a position within the game card processing device 214 whereat a scanner 260 of the game card processor 240 can scan the game card. The scanner 260 can be any suitable scanner such as, for example, an optical scanner that may be used to read a barcode or other encoded marking on the game card. As will be appreciated, other types of scanners can be utilized depending on the form of information to be read from the game card. For example, it is possible to embed unique RFID chips in game cards. In such case, the scanner 260 may be an RFID scanner configured to read an RFID transponder associated with the game card.

The scanner 260 is in communication with the microprocessor 250 and is configured to send information scanned from the game card to the microprocessor 250 for verification/validation. For example, the scanner 260 may read a unique number from a game card which would be sent to the microprocessor 250. The microprocessor 250 may check the unique number against a look-up table or other database stored in memory 254 to determine whether the scanned card is a winning card.

In the event that the scanned card is validated as a winning card and a player accepts an offer to receive credit on the dispenser 212 in the amount of the winning card, the game card processor 240 can be configured to deface or otherwise destroy the scanned game card or a portion thereof in order to render the card useless. For example, a punch 262 may be provided for punching the game card. In one embodiment, the punch 262 may be configured to remove or destroy a portion of the game card containing the information relating to the unique number associated with the game card such that it would no longer be possible to determine whether the game card is a winning game card. To this end, the punch 262 may be configured to physically remove a portion of a barcode printed on the game card. In the case that an RFID transponder is embedded in the game card, the punch 262 could be replaced with a RFID disabling device that transmits a relatively powerful pulse of energy to destroy the RFID transponder and thereby render it useless.

Once a card is defaced or destroyed, it can then be retained within the game card processing device 214 in a storage bin 264 or the like. By retaining the game cards that are redeemed for credits on the dispensing machine 212, the game card processing device 214 maintains control over said cards such that they are not then placed back into the public's hands where they could be potentially manipulated and/or used in a fraudulent manner to obtain an additional payout. Each time a game card is redeemed via the game card processing device 214, a record of the transaction may be stored in memory 254 and/or a hard copy printed receipt may be printed by printer 256. These records of the transaction can then be used for auditing the games in order to further ensure fair play.

In one exemplary embodiment, the game card processing device 214 is operative to sense when a ticket is inserted into the ticket processor 240 and in response thereto, start the motor/drive 258 to advance the ticket to a second position where a sensor 266 senses the card's presence and stops the motor drive 258. At this point, the scanner 260 reads the barcode (or otherwise scans information from the card) and displays the payout value on the display 246. The player then has the option to push the accept/credit button 242 and thereby accept the receipt of credits for dispensing of additional cards from dispenser 212, or the player can request the return of the ticket without credit. If credit/accept button 242 is pushed by the player, the motor/drive 258 starts and advances the game card until another sensor 266 detects the card at a different location at which time the game card is stopped and the barcode is punched out by punch 262. The motor drive 258 then starts again and expels the game card out of the motor drive 258 and into storage bin 264. If the return/reject button 244 is pushed by the player, the motor drive 258 is reversed and returns the game card to the player. No credits are forwarded to the dispenser 212 nor is the barcode on the game card defaced or otherwise punched. The player is then free to take the game card to a conventional location, such as a cashier or the like, for redemption or discard a non-winning ticket.

It should be appreciated that a certain level of cooperation between the game card dispenser 212 and game card processing device 214 can enhance operation of the system 210 and ensure that only a game card dispensed from dispenser 212 can be redeemed by game card processing device 214. For example, for a given game, there may be a stack of two-hundred (200) game cards in dispenser 212. An administrator of the system 210 may choose to load a complete set of game cards into dispenser 212 and authorize game card processing device 214 to payout winning game cards associated with the given game loaded into the dispenser 212. To this end, information may be programmed into the processing device 214 and/or sent to the processing device 214 from the dispenser 212. Such information may relate to the total number of cards in the game, the unique ticket identifiers of winning cards, and any other pertinent information that may be used by the processing device 214 to verify winning cards. It will be appreciated that any suitable means of conveying such information to the card processing device 214 can be used. For example, the card processing device 214 or 212 could be connected to a remote server that includes information relating to a particular game. Alternatively, a special card could be inserted into the game card processor 240, such special card configured to be scanned by the game card processor 214 and containing the necessary information to process the game card associated with the particular game, and/or simply to authorize the game card processing device 214 to process cards from a particular game.

In addition, the game card dispenser 212 can be configured to communicate with the game card processing device 214 the status information of the dispenser 212. For example, if a player inserts a card into the game card processing device 214 and the game card is determined to be a winning card with a value of $10.00, the game card processing device 214 can be configured to query the game card dispenser 212 regarding whether or not there is at least $10.00 worth of game cards left for dispensing from the dispenser 212. In the case that the game card dispenser has less than $10.00 of game cards left for dispensing, the game card processing device 214 can be configured to return the game card to the player with an indication on the display 246 that the amount of the winning card exceeds the available game cards for play remaining in the game card dispenser 212. The game card dispenser 212 can also be configured to communicate other events to the game card processing device 214 such as when a game is completely sold out. Other information, such as operating status of the game card dispenser 212, may also be communicated to the game card processing device 214. For example, if the game card dispenser 212 is out of service, such information, when received by the game card processing device 214, could be used to place the game card processing device 214 out of service as well. As an alternative, the game card processing device 214 could be configured to simply read game cards and display a winning amount without offering credits on the dispenser 212. In this sense, the game card processing device 214 would simply serve as a game card verifier.

Figure 9:
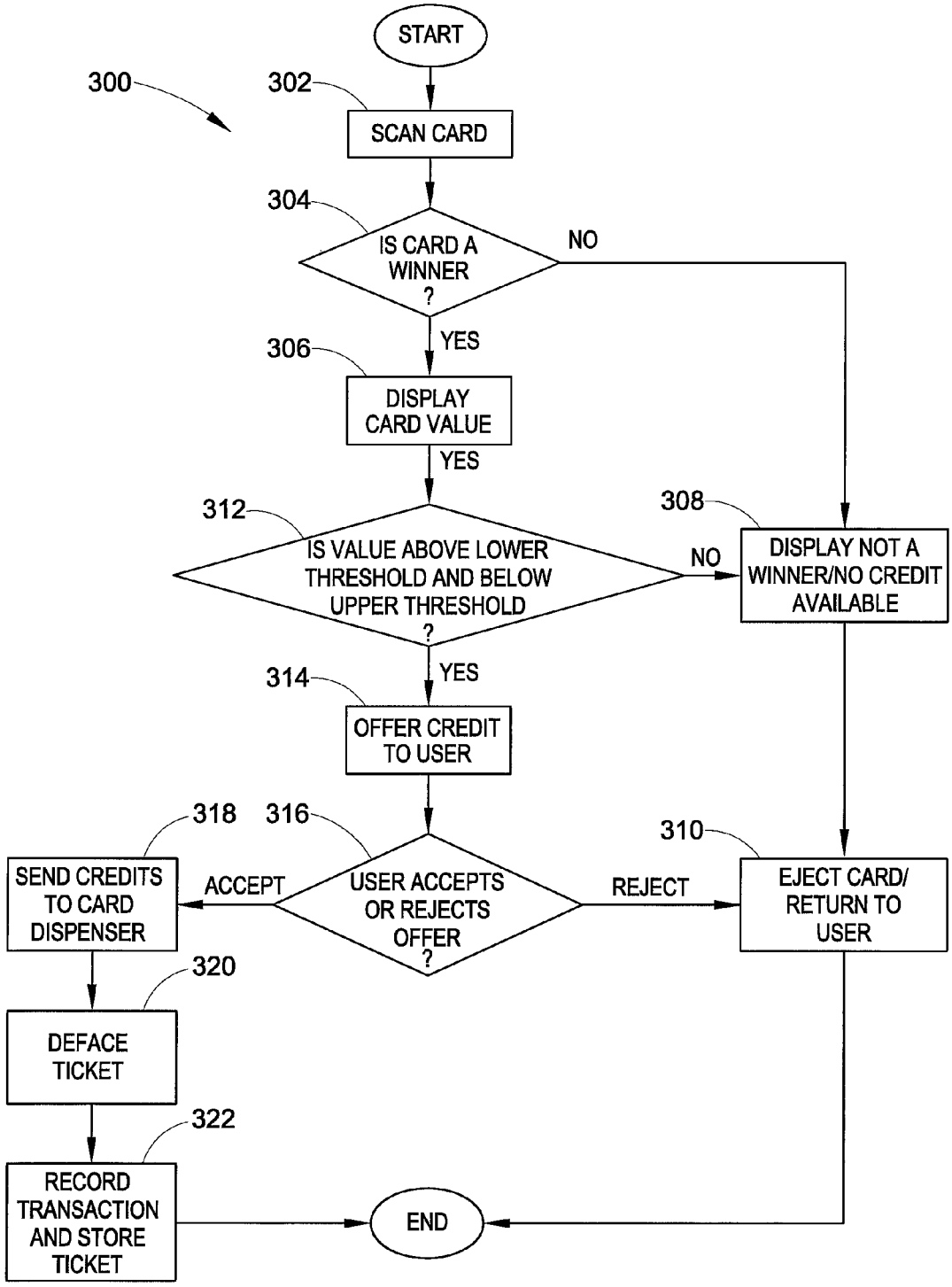
FIG. 9 is a flowchart of an exemplary method of use of the game card dispensing system of FIG. 7 in accordance with the disclosure.

Turning now to FIG. 9, an exemplary method in accordance with the present disclosure is illustrated generally by reference numeral 300. The method 300 can be carried out by the exemplary game card dispensing system 210 illustrated in FIGS. 7 and 8, or as will be appreciated, by other devices capable of carrying out the steps of the method. The method begins with the process of step 302 whereat a game card is scanned. At process step 304, the status of the game card is determined. If the game card is determined to be a winning game card, then a credit value associated with the card is displayed or otherwise communicated to a player in process step 306. If in process step 304, the card is determined not to be a winning card, then the same is communicated to the player in process step 308 and the card is returned to the player in process step 310.

Returning to process step 306, the winning card's associated value is displayed or otherwise communicated to the player and, at process step 312, the credit value of the winning card is compared to a lower threshold and an upper threshold. In general, these thresholds will be set based upon operating characteristics of the particular game being played. For example, a lower threshold may be a minimum game card price of an associated game card dispenser. In such case, if the credit value of the winning card is less than the cost of a single game card for sale in the associated game card dispenser, then no credit would be offered to a player since such credit would be insufficient to purchase a game card from the dispenser.

An example of an upper threshold is a maximum value that the game card processing device is configured to credit a user. In one arrangement, a game card processing device may be configured to only offer credits on the associated game card dispenser for winning tickets below a certain dollar amount, such as $20.00. If a game card is inserted into the processing device and it is determined that the game card is a winning card with a credit value greater than $20.00, the game card processing device may be configured to return the card to the player and display or otherwise communicate to the player that the amount of the card exceeds the maximum amount allowed for processing by the processing device.

Another example of an upper threshold is the total value of game cards remaining for dispensing from the associated dispenser. For example, if a game card dispenser has a total of $15.00 worth of game cards left to be dispensed to players, if a winning card is presented to the game card processing device with a credit value greater than $15.00, then there are not enough cards remaining in the card dispenser to satisfy the total amount of the winning game card, and the game card processing device may be configured to return the game card to the player and display or otherwise communicate to the player that the remaining game cards in the dispenser are insufficient to satisfy the value of the winning card.

Figure 10:
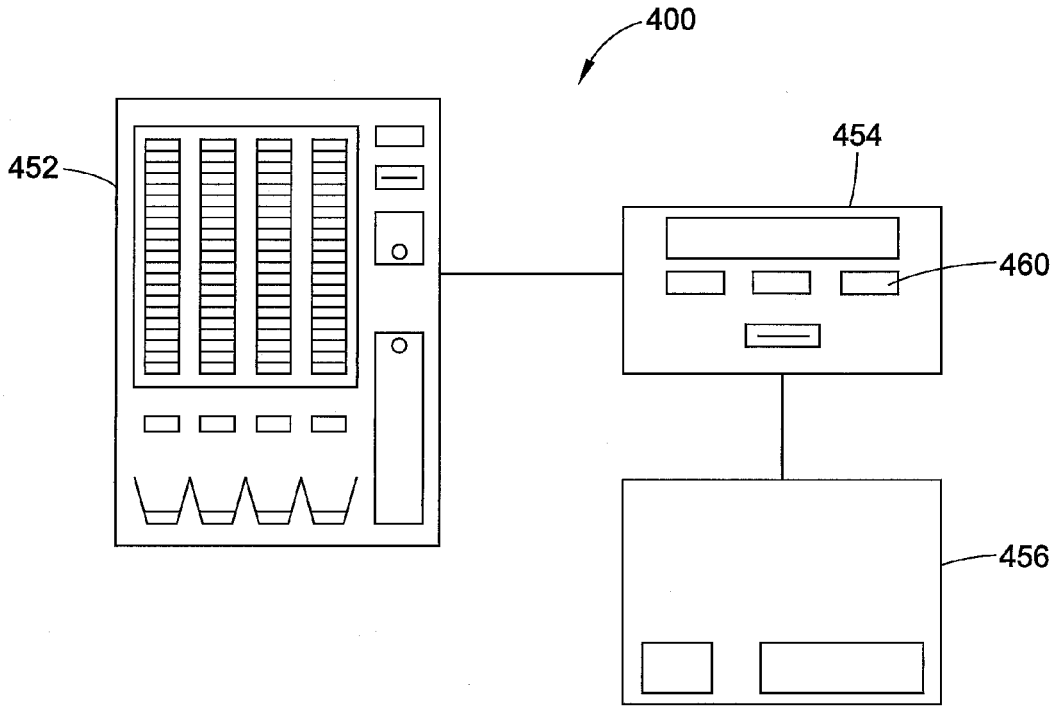
FIG. 10 is a front view of another exemplary game card dispensing system according to a third embodiment of the present disclosure having a game card dispenser, a game card processing device and a cash-out center.

Returning to the exemplary method 300 and specifically process step 312, if the credit value of the game card is not above the lower threshold and below the upper threshold, then the method proceeds to process step 308 whereat the player is informed that no credit is available and the game card is then returned to the user in process step 310. If at process step 312 it is determined that the credit value of the playing card is above the lower threshold and below the upper threshold, then credit for purchasing additional game cards is offered to the user at process step 314. At process step 316, a user can accept or reject the offer for credit. If the player rejects the offer, the method proceeds to process step 310 whereat the card is ejected and returned to the player. If the player accepts the offer for credits, then the method proceeds to process step 318 whereat the credit value of the winning card is sent to the associated game card dispenser. The winning ticket is defaced at process step 320 and the transaction is recorded and the ticket is retained in process step 322. Depending on regulatory requirements, it can be appreciated that the winning card can be defaced just prior to rather than after crediting the dispensing machine Turning now to FIG. 10, another exemplary system 400 in accordance with a third embodiment of the disclosure is there illustrated. It includes a game card dispenser 452, a game card processing device 454, and a cash out center 456. The game card dispenser 452 may be any suitable game card dispenser such as game card dispenser 10 shown in FIG. 1 or the dispenser 212 described in connection with FIGS. 7 and 8. Similarly, the game card processing device 454 may be, for example, a game card processing device like device 214 of FIGS. 7 and 8. The game card dispenser 452 and game card processing device 454 can operate in a similar manner to the dispenser 212 and processing device 214 described previously.

In this embodiment, the cash out center 456 provides an additional option to a player for redeeming a winning game card purchased from the game card dispenser 452. As will be appreciated, the cashout center 456 is in communication with the game card processing device 454 and is adapted to receive commands from the game card processing device relating to dispensing of payment for winning game cards. To this end, the game card processing device 454 can include an additional user input in the form of a cashout button 460 (in addition to the accept/credit button and reject/return button). Thus, a player has the additional option to select the cash out rather than accept credit from the ticket dispenser 452. Use of a cashout center is advantageous from the standpoint that it reduces the need to engage personnel at the playing establishment.

If a user selects cashout, the game card processing device 454 is adapted to send a signal to the cashout center 456 indicative of a credit value associated with a game card determined to be a winning game card and the cashout center 456 is configured to dispense a corresponding amount of cash to a player thereby effecting the cashout. It will be appreciated that the cashout center 456 is optional and may not be available in all jurisdictions.

The instant disclosure has been described with reference to the preferred embodiments. Obviously, modifications and alterations will occur to others upon reading and understanding the preceding detailed description. It is intended that this disclosure be construed as including all such modifications and alterations insofar as they come within the scope of the appended claims or the equivalents thereof.

The invention claimed is:

1. A ticket dispensing mechanism for dispensing a single associated ticket from a stack of associated tickets comprising:

a first ticket engaging member for advancing the single associated ticket at a first rate of speed;

a second ticket engaging member located downstream of the first ticket engaging member for advancing the single associated ticket at a second rate of speed which is greater than the first rate of speed;

a third ticket engaging member located downstream of the second ticket engaging member for advancing the single associated ticket at a third rate of speed which is greater than the second rate of speed;

wherein the associated ticket has length greater than a) the spacing between the first and second ticket engaging members and b) the spacing between the second and third ticket engaging members such that as the associated ticket advances through the ticket dispensing mechanism, the second ticket engaging member engages the associated ticket before the first ticket engaging member disengages the associated ticket and the third ticket engaging member engages the associated ticket before the second ticket engaging member disengages the associated ticket; and wherein the second ticket engaging member engages an associated ticket with a force greater than a force of engagement of the first and third ticket engaging members, whereby the speed of the associated ticket is determined by the second ticket engaging member when the associated ticket is engaged with the second ticket engaging member.

2. A ticket dispensing mechanism as set forth in claim 1, wherein the first, second and third ticket engaging members each include at least one roller adapted to engage a surface of an associated ticket.

3. A ticket dispensing mechanism as set forth in claim 2, wherein each of the at least one roller of the first, second and third ticket engaging members is operatively coupled to a common drive gear.

4. A ticket dispensing mechanism as set forth in claim 2, wherein the second ticket engaging member includes a toothed roller for engaging a surface of an associated ticket.

5. A ticket dispensing mechanism as set forth in claim 4 wherein the roller of the second ticket engaging member comprises a metal.

6. A ticket dispensing mechanism as set forth in claim 5 wherein the at least one roller of the first and third ticket engaging members comprises an elastomeric material.

7. A ticket dispensing mechanism as set forth in claim 1, wherein the associated ticket has length greater than the combined distance of the spacing between the first and second ticket engaging members and the spacing between the second and third ticket engaging members such that as the associated ticket advances through the ticket dispensing mechanism, the first, second and third ticket engaging members can simultaneously engage the associated ticket.

8. A ticket dispensing mechanism as set forth in claim 1, further comprising a stripper arm positioned between the second and third ticket engaging members for removing a flap of an associated ticket.

9. A ticket dispensing mechanism as set forth in claim 8, further comprising a ticket scanner for scanning information from the associated ticket.

10. A ticket dispensing machine including the ticket dispensing mechanism of claim 1.

11. A ticket dispensing machine as set forth in claim 10 including an automated ticket collection device for collecting played tickets dispensed from the machine.

12. A ticket dispensing machine as set forth in claim 10, including a ticket redemption slot into which a player can insert a ticket for redemption.

* * * * *